United States Patent [19]

Clark et al.

[11] Patent Number: 4,491,510

[45] **Date of Patent: * Jan. 1, 1985**

[54] MONOLITHIC COMPOSITE ELECTRODE FOR MOLTEN SALT ELECTROLYSIS

[75] Inventors: James M. Clark, Johnson City; Duane R. Secrist, Elizabethton, both of Tenn.

[73] Assignee: Great Lakes Carbon Corporation, New York, N.Y.

[ * ] Notice: The portion of the term of this patent subsequent to Apr. 5, 2000 has been disclaimed.

[21] Appl. No.: 460,891

[22] Filed: Jan. 24, 1983

Related U.S. Application Data

[63] Continuation-in-part of Ser. No. 241,535, Mar. 9, 1981, abandoned.

[51] Int. Cl.[3] ..... C25C 3/06; C25B 11/00

[52] U.S. Cl. ..... 204/290 R; 204/292; 264/61; 264/62

[58] Field of Search ..... 204/290 R, 292; 264/61, 264/62

[56] References Cited

U.S. PATENT DOCUMENTS

| | | | |
|---|---|---|---|
| 2,467,144 | 4/1949 | Mochel | 106/55 |
| 2,490,825 | 2/1946 | Mochel | 106/55 |
| 3,718,550 | 2/1973 | Klein | 204/67 |
| 3,930,967 | 1/1976 | Alder | 204/67 |
| 3,960,678 | 6/1976 | Alder | 204/67 |
| 4,039,401 | 8/1977 | Yamada et al. | 204/67 |
| 4,057,480 | 11/1977 | Alder | 204/290 R |
| 4,098,651 | 7/1978 | Alder | 204/1 T |
| 4,098,669 | 4/1978 | de Nora et al. | 204/252 |
| 4,146,438 | 3/1979 | de Nora et al. | 204/1.5 |
| 4,233,148 | 11/1980 | Ramsey et al. | 204/291 |
| 4,379,033 | 4/1983 | Clark et al. | 204/67 |

OTHER PUBLICATIONS

Belyaev & Studentsov, *Legkie Metal* 6, No. 3, 17–24 (1937), (C.A. 31 [1937], 8384).

Belyaev, *Legkie Metal* 7, No. 1, 7–20 (1938), (C.A. 32 [1938], 6553).

*Primary Examiner*—John F. Niebling

*Attorney, Agent, or Firm*—R. Laddie Taylor

[57] ABSTRACT

A non-consumable electrode having a substantially flat working surface suitable for use as an anode in molten salt electrolysis, particularly for the production of aluminum in Hall-Heroult reduction cells, is produced by a process wherein at least the portion of a conductive core that is exposed to the electrolyte bath is coated with a composition of higher resistivity than the core composition to provide uniform current density at all regions of the working surface of the anode.

31 Claims, 2 Drawing Figures

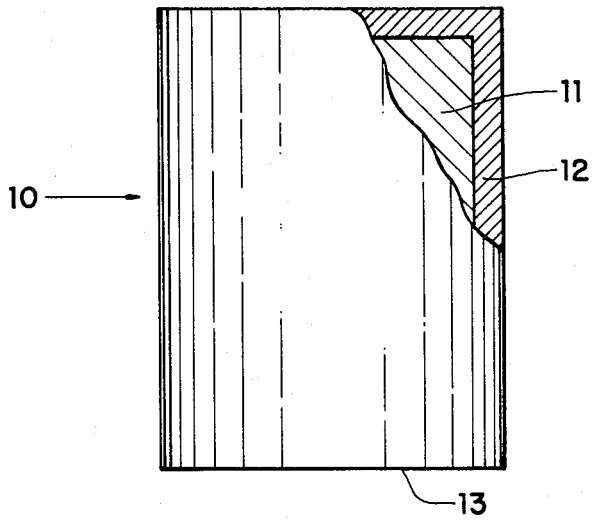
· Fig. 1 ·
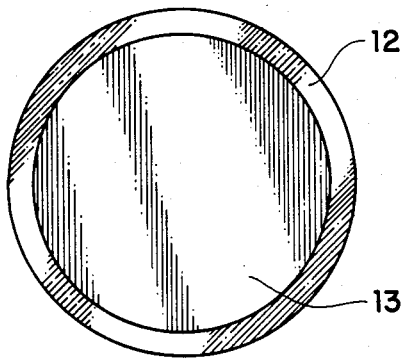
· Fig. 2 ·

MONOLITHIC COMPOSITE ELECTRODE FOR MOLTEN SALT ELECTROLYSIS

DESCRIPTION

This application is a continuation-in-part of application Ser. No. 241,535, filed Mar. 9, 1981, abandoned.

BACKGROUND OF THE INVENTION

1. Field Of The Invention

The invention relates to improved non-consumable electrodes, particularly for use in the production of aluminum in Hall-Heroult cells, and to a method for achieving a uniform current density on the electrode working surface.

2. Description Of The Prior Art

Aluminum is conventionally produced in Hall-Heroult cells by the electrolysis of alumina in molten cryolite, using conductive carbon electrodes. During the reaction, the carbon anode is consumed at the rate of approximately 450 kg/mT of aluminum produced under the overall reaction $$2Al_2O_3 + 3C \xrightarrow[Na_3AlF_6]{940°-1000° C.} 4Al + 3CO_2.$$

The problems caused by the use of carbon anodes are related to the cost of the anode consumed in the above reaction and to the impurities introduced to the melt from the carbon source. The petroleum cokes used in the fabrication of the anodes generally have significant quantities of impurities, principally sulfur, silicon, vanadium, titanium, iron and nickel. Sulfur is oxidized to its oxides, causing troublesome workplace and environmental pollution problems. The metals, particularly vanadium, are undesirable as contaminants in the aluminum metal produced. Removal of excess quantities of the impurities requires extra and costly steps when high purity aluminum is to be produced.

If no carbon were consumed in the reduction the overall reaction would be $2Al_2O_3 \rightarrow 4Al + 3O_2$ and the oxygen produced could theoretically be recovered. More importantly, with no carbon consumed at the anode there would be no contamination of the atmosphere or the product from the impurities present in the coke.

Attempts have been made in the past to use non-consumable electrodes with little apparent success. Metals either melt at the temperature of operation, or are attacked by oxygen and/or the cryolite bath. Ceramic compounds, such as oxides with perovskite and spinel crystal structures, usually have too high electrical resistance or are attacked by the cryolite bath.

Previous efforts in the field are disclosed in U.S. Pat. No. 3,718,550—Klein, Feb. 27, 1973, Cl. 204/67; U.S. Pat. No. 4,039,401—Yamada et al., Aug. 2, 1977, Cl. 204/67; U.S. Pat. No. 2,467,144—Mochel, Apr. 12, 1949, Cl. 106/55; U.S. Pat. No. 2,490,825—Mochel, Feb. 1, 1946, Cl. 106/55; U.S. Pat. No. 4,098,669—de Nora et al., July 4, 1978, Cl. 204/252; Belyaev+-Studentsov, *Legkie Metal* 6, No. 3, 17-24 (1937), (C.A. 31 [1937], 8384) and Belyaev, *Legkie Metal* 7, No. 1, 7-20 (1938) (C.A. 32 [1938], 6553).

Of the above references, Klein discloses an anode of at least 80% $SnO_2$, with additions of $Fe_2O_3$, ZnO, $Cr_2O_3$, $Sb_2O_3$, $Bi_2O_3$, $V_2O_5$, $Ta_2O_5$, $Nb_2O_5$ or $WO_3$. Yamada discloses spinel structure oxides of the general formula $XYY'O_4$ and perovskite structure oxides of the $CoCr_2O_4$, $TiFe_2O_4$, $NiCr_2O_4$, $NiCo_2O_4$, $LaCrO_3$, and $LaNiO_3$. Mochel discloses $SnO_2$ plus oxides of Ni, Co, Fe, Mn, Cu, Ag, Au, Zn, As, Sb, Ta, Bi and U. Belyaev discloses anodes of $Fe_2O_3$, $SnO_2$, $Co_3O_4$, NiO, ZnO, CuO, $Cr_2O_3$ and mixtures thereof as ferrites. De Nora discloses $Y_2O_3$ with Y, Zr, Sn, Cr, Mo, Ta, W, Co, Ni, Pd, Ag, and oxides of Mn, Rh, Ir, and Ru.

The Mochel patents relate to electrodes for melting glass, while the remainder are intended for high temperature electrolysis, such as Hall-Heroult aluminum reduction. Problems with the materials above are related to the cost of the raw materials, the fragility of the electrodes, the difficulty of making a sufficiently large electrode for commercial usage, and the low electrical conductivity of many of the materials above when compared to carbon anodes.

U.S. Pat. No. 4,146,438, Mar. 27, 1979, de Nora et al., Cl. 204/1.5, discloses electrodes comprising a self-sustaining body or matrix of sintered powders of an oxycompound of at least one metal selected from the group consisting of titanium, tantalum, zirconium, vanadium, niobium, hafnium, aluminum, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series and at least one electroconductive agent the electrodes being provided over at least a portion of their surface with at least one electrocatalyst.

U.S. Pat. No. 3,930,967—Alder, Jan. 6, 1976, Cl. 204/67, discloses bi-polar electrodes made by sintering formed mixtures of $SnO_2$, as a principal component, with small percentages of $Sb_2O_3$, $Fe_2O_3$ and CuO.

U.S. Pat. No. 3,960,678—Alder, June 1, 1976, Cl. 204/67, discloses a Hall-Heroult process using an anode having a working surface of ceramic oxide, wherein a current density above a minimum value is maintained over the whole anode surface to prevent corrosion. The anode is principally $SnO_2$, preferably 80.0 to 99.7 wt. %. Additive oxides of Fe, Cu, Sb and other metals are disclosed.

U.S. Pat. No. 4,057,480—Alder, Nov. 8, 1977, Cl. 204/290 R, a divisional application from U.S. Pat. No. 3,960,678, relates to a ceramic oxide anode for a Hall-Heroult cell using a current density maintained above a minimum value over the contact surface of the anode. A protective ring is fitted over the three phase zone at the air-electrolyte-anode junction. Anode base material of $SnO_2$, 80.0-99.7 wt. % is shown with additions of 0.05-2.0 wt. % of oxides of Fe, Cu, Sb and other metals as dopants.

U.S. Pat. No. 4,233,148—Ramsey et at., Nov. 11, 1980, Cl. 204/291, discloses electrodes suitable for use in Hall-Heroult cells composed of $SnO_2$ with various amounts of conductive agents and sintering promoters, principally $GeO_2$, $Co_3O_4$, $Bi_2O_3$, $Sb_2O_3$, $MnO_2$, CuO, $Pr_2O_3$, $In_2O_3$ and $MoO_3$.

Despite the efforts described above, preparation of usable electrodes for Hall-Heroult cells still has not been fully realized and no instance is known of any plant scale commercial usage. The spinel and perovskite crystal structures have in general displayed poor resistance to the molten cryolite bath, disintegrating in a relatively short time. Electrodes consisting of metals coated with ceramics using conventional methods have also shown poor performance, in that almost inevitably, even the smallest crack leads to attack on the metal substrate by the cryolite, resulting in spalling of the coating, and consequent destruction of the anode.

The most promising developments to date appear to be those using stannic oxide, which has a rutile crystal structure, as the basic matrix. Various conductive and catalytic compounds are added to raise the level of electrical conductivity and to promote the desired reactions at the working surface of the anode.

A major cause of the difficulties experienced with the use of conductive anodes having flat working surfaces in Hall-Heroult cells is the high current densities that exist at the edges and corners of the anodes. As a result, the operating life of these anodes is shortened by selective attack of these regions by the molten electrolyte bath. Regarding anodes having a protective surface covering, it has been accepted and common practice to utilize a material of very high electrical resistivity for the covering, compared to the resistivity of the protected material.

BRIEF DESCRIPTION OF THE DRAWINGS

The invention will become more apparent when described in conjunction with the drawings, in which like reference numerals designate like parts in the views, and wherein:

FIG. 1 is a side view, partially in section, of the electrode of our invention.

FIG. 2 is a bottom view of the electrode of FIG. 1.

SUMMARY OF THE INVENTION

The primary objective of the invention is to provide an improved electrode having a substantially flat working surface and wherein a uniform current density exists at all available regions of the working surface of the electrode during operation thereof in a molten salt electrolysis cell. The uniform current density inhibits selective attack of the electrode and provides improved process control.

It is another objective of the invention to provide an improved electrode wherein the requirement of large differences between the electrical resistivity of the core and core-protecting material is greatly relaxed.

The invention provides a non-consumable electrode 10 particularly, but not exclusively, suitable as an anode for a Hall-Heroult cell having a molten electrolyte bath at cell operating temperature which essentially achieves a uniform current density across its flat working surface 13 and may be produced from materials having a relatively small difference in electrical resistivity. The electrode 10 and especially an anode is generally produced by the process of: (a) forming, preferably by isostatic pressing, a first conductive ceramic material to produce a core 11 having a substantially flat working surface 13 and a non-working surface; (b) forming a physically adherent coating 12 over the non-working surface of the core 11 on at least the portion thereof which is to be exposed to the electrolyte bath in the cell, the coating 12 consisting of a second conductive ceramic material having a closely matching coefficient of thermal expansion, a close matching of strinkage during sintering, and a higher electrical resistivity compared to the first conductive ceramic material and capable of being chemical diffusion bonded thereto; and (c) sintering the coated core thus formed to produce a monolithic ceramic electrode 10 having a substantially flat working surface 13 and a non-working surface, the non-working surface having an impervious coating 12 thereon, at least in the portion thereof exposed to the electrolyte bath, of higher resistivity than the core 11 and chemical diffusion bonded thereto, whereby substantially all of the current applied to the electrode 10 is conducted into the electrolyte bath through the flat working surface 13.

Suitable means for transferring current to the electrode core 11 must, of course, pass through the coating 12.

The phrase "physically adherent coating over the non-working surface of the core" refers to a coated core possessing sufficient integrity such that it can be handled and shaped without separation of the coating from the core. A particularly suitable method for applying an adherent coating is the isostatic pressing method. The adherence in this case is derived from the physical interpenetration of coating and core materials at the adjoining interface. Other coating methods, such as flame spraying or dipping, which permit subsequent chemical diffusion bonding of the coating during sintering may also be used.

The phrase "closely matching coefficient of thermal expansion" refers to the requirement that the CTE of the coating and core materials of the electrode should differ by no more than about $1.0\times10^{-6}/°$ C. to prevent destruction of the electrode during use. In a preferred system, the CTE difference is limited to no more than about 0.5%.

Likewise, the phrase "a close matching" of shrinkage refers to the requirement that the coating and core materials must undergo an essentially equivalent dimensional or volume change during sintering.

Chemical diffusion bonding as used herein is defined as the cohesion resulting from the mutual migration of the coating and core constituents across an adjoining interface to form an interphase region with chemical composition intermediate between that of the coating and the core and compatible with each.

An electrode produced by our process which particularly lends itself to commercial production involves: (a) forming an elongated core having two ends from a first conductive ceramic material; (b) forming a physically adherent coating over the core with a second conductive ceramic material having a closely matching coefficient of thermal expansion, a close matching of strinkage during sintering, and a higher electrical resistivity compared to the first conductive ceramic material and capable of being chemical diffusion bonded thereto; (c) producing a substantially flat uncoated working surface on only one end of the coated core by removing the coating therefrom; and (d) sintering the coated core having a substantially flat uncoated working surface to produce an integral monolithic body with an impervious coating layer, thereby forming a ceramic electrode having a substantially flat working surface and a non-working surface, the non-working surface having a coating of higher resistivity than the core and chemical diffusion bonded thereto, whereby substantially all of the current applied to the electrode is conducted into the electrolyte bath through the flat working surface. The preferred method for forming the elongated core and physically adherent coating is isostatic pressing.

The preferred conductive ceramic core composition for the electrode consists of 98.0–98.5 wt. % $SnO_2$, 0.1–0.5 wt. % CuO and 1.0–1.5 wt. % $Sb_2O_3$. A particularly advantageous core composition consists of 98.5 wt. % $SnO_2$, 0.5 wt. % CuO and 1.0 wt. % $Sb_2O_3$.

The preferred conductive ceramic coating material is an $Fe_2O_3$-doped $SnO_2$ composition, preferably consisting of 98.00–99.75 wt. % $SnO_2$ and 0.25–2.00 wt. % $Fe_2O_3$, and ideally 98.0 wt. % $SnO_2$ and 2.0 wt. % $Fe_2O_3$.

DESCRIPTION OF THE PREFERRED EMBODIMENT

The following example will further describe the invention. It is understood that this example is provided to illustrate the practice of the invention and is not intended as limiting beyond the limitations imposed by the appended claims.

Core Material Preparation

A powder mixture consisting of 985 grams $SnO_2$, 5 grams CuO and 10 grams $Sb_2O_3$ was wet milled for six hours, after which the resulting slurry was vacuum filtered and dried by means well known in the art. The dried material was screened through a sieve having openings of about 425 microns (40 mesh Tyler Screen Scale), and then calcined at 900° C. in air to promote chemical reactivity and improve homogeneity. The wet-milling, vacuum filtration, and drying steps were repeated to provide powdered material with which to produce the anode core.

Coating Material Preparation

A powder mixture consisting of 980 grams $SnO_2$ and 20 grams $Fe_2O_3$ was treated in an identical manner as was used in the core material preparation described above to produce a powder for use in coating the anode core.

Anode Fabrication

A 110 gram sample of the core material was molded in a vibrated cylindrical mold and then pressed isostatically at a pressure of about 1265 kg/cm$^2$ (18,000 psi) to form a cylindrical anode core having approximate dimensions of 2.75 inches by 1 inch diameter. The coating material was then molded onto the formed core by inserting the core into a cylindrically shaped mold having larger diameter than the core and filling the void space surrounding the core with coating material. The coating material was compacted by vibrating. The coated core was then isostatically pressed at a pressure of about 1406 kg/cm$^2$ (20,000 psi). Finally, the coating was removed from both ends of the thus-formed body by sanding to provide both a substantially flat working surface at one end thereof and a location for connecting the power lead to the opposite end.

The body was then sintered in oxygen at about 1420° C., using an 8 hour upheat rate and a 4 hour hold at maximum temperature. The resistivities of the core and coating material at 975° C. were 0.0025 ohm·cm and 0.22 ohm·cm, respectively. The Archimedes density of the sintered body was 95.4% of the theoretical density of 6.95 g/cm$^3$.

Densities 98% of the theoretical density have been obtained by sintering an identical body in oxygen at 1420° C. using a 6 hour upheat rate and a 2 hour hold at maximum temperature.

Anode Testing

Testing of the coated monolith as an anode was conducted in a pilot scale Hall-Heroult cell at about 980° C., the melt having the following composition:

$Na_3AlF_6$: 82.6 wt. %
$AlF_3$: 2.4 wt. %
$CaF_2$: 7.0 wt. %
$Al_2O_3$: 8.0 wt. %

Throughout the duration of the test, the melt was replenished periodically to maintain approximately the starting composition. One third of the anode was immersed vertically in the melt. After 175 hours of electrolysis at a current density of 1 amp/cm$^2$, the anode retained its structural integrity, exhibiting no visual sign of thermally-induced shock or other indication of separation of the coating from the core. The uniform appearance of the working surface of the anode coupled with the absence of corrosion at the lower, sharp edges of the coating presented conclusive evidence that the electrolysis current was constrained substantially to the central core region bounded by the coating. The electrochemical corrosion of the working surface of the anode was so slight as to not be readily capable of being quantified by physical measurements. The recorded weight and dimensional changes of the anode were of the same order of magnitude as the accuracy of the measurements. The coating layer exhibited high corrosion resistance both above and below the melt level and in the region of the melt/ambient interface.

While the invention has been described in detail and with reference to a specific embodiment thereof, it will be apparent to one skilled in the art that various changes and modification can be made therein without departing from the scope and spirit thereof, and, therefore, the invention is not intended to be limited except as indicated in the appended claims.

What is claimed is:

1. A non-consumable electrode suitable for use as an anode in the electrolysis of molten salts, produced by the process of:

(a) forming a first conductive ceramic material to produce a core having a substantially flat working surface and a non-working surface;

(b) forming a physically adherent coating over said non-working surface of said core, on at least the portion thereof which is to be exposed to the electrolyte bath in the cell, said coating consisting of a second conductive ceramic material having, as compared to said first conductive ceramic material, (1) a coefficient of thermal expansion differing by no more than about $1.0\times10^{-6}$/° C., (2) an essentially matched strinkage during sintering, (3) a higher electrical resistivity, and capable of being chemical diffusion bonded thereto; and (c) sintering the coated core thus formed to produce a monolithic ceramic electrode having a substantially flat working surface and a non-working surface, said non-working surface having an impervious coating thereon, at least in the portion thereof exposed to the electrolyte bath, of higher resistivity than the core and chemical diffusion bonded thereto, whereby substantially all of the current applied to said electrode is conducted into the electrolyte bath through said flat working surface.

2. A non-consumable anode for a Hall-Heroult cell having a molten electrolyte bath at cell operating temperature produced by the process of:

(a) forming an elongated core having two ends from a first conductive ceramic material;

(b) forming a physically adherent coating over said core with a second conductive ceramic material having, as compared to said first conductive ceramic material, (1) a coefficient of thermal expansion differing by no more than about $1.0\times10^{-6}$/° C., (2) an essentially matched shrinkage during sintering, (3) a higher electrical resistivity, and capable of being chemical diffusion bonded thereto;

(c) producing a substantially flat uncoated working surface on only one end of the coated core by removing the coating therefrom; and (d) sintering the coated core having a substantially flat uncoated working surface to produce an integral monolithic body with an impervious coating layer, thereby forming a ceramic anode having a substantially flat working surface and a non-working surface, said non-working surface having a coating of higher resistivity than said core and chemical diffusion bonded thereto, whereby substantially all of the current applied to said anode is conducted into said electrolyte bath through said flat working surface.

3. A non-consumable anode for a Hall-Heroult cell having a molten electrolyte bath at cell operating temperature produced by the process of:

(a) isostatically pressing a first conductive ceramic material to produce a core having a substantially flat working surface and a non-working surface;

(b) isostatically pressing a second conductive ceramic material having, as compared to said first conductive ceramic material, (1) a coefficient of thermal expansion differing by no more than about $1.0\times10^{-6}/°$ C., (2) an essentially matched shrinkage during sintering, (3) a higher electrical resistivity, and capable of being chemical diffusion bonded thereto to form a physically adherent coating over said non-working surface of said core, on at least the portion thereof which is to be exposed to the electrolyte bath in the cell; and (c) sintering the coated core thus formed to produce a monolithic ceramic anode having a substantially flat working surface and a non-working surface, said non-working surface having an impervious coating thereon, at least in the portion thereof exposed to the electrolyte bath, of higher resistivity than the core and chemical diffusion bonded thereto, whereby substantially all of the current applied to said anode is conducted into the electrolyte bath through said flat working surface.

4. A non-consumable anode for a Hall-Heroult cell having a molten electrolyte bath at cell operating temperature manufactured by the process of:

(a) producing an elongated core having two ends by isostatically pressing a first conductive ceramic material;

(b) forming a physically adherent coating over said core by isostatically pressing on the surface thereof a second conductive ceramic material having, as compared to said first conductive ceramic material, (1) a coefficient of thermal expansion differing by no more than about $1.0\times10^{-6}/°$ C., (2) an essentially matched shrinkage during sintering, (3) a higher electrical resistivity, and capable of being chemical diffusion bonded thereto;

(c) producing a substantially flat uncoated working surface on only one end of the coated core by removing the coating therefrom; and (d) sintering the coated core having a substantially flat uncoated working surface to produce an integral monolithic body with an impervious coating layer, thereby forming a ceramic anode having a substantially flat working surface and a non-working surface, said non-working surface having a coating of higher resistivity than said core and chemical diffusion bonded thereto, whereby substantially all of the current applied to said anode is conducted into said electrolyte bath through said flat working surface.

5. A process for producing a non-consumable electrode suitable for use as an anode in the electrolysis of molten salts, which comprises:

(a) forming an elongated core having two ends from a first conductive ceramic material;

(b) forming a physically adherent coating over said core with a second conductive ceramic material having, as compared to said first conductive ceramic material, (1) a coefficient of thermal expansion differing by no more than about $1.0\times10^{-6}/°$ C., (2) an essentially matched shrinkage during sintering, (3) a higher electrical resistivity, and capable of being chemical diffusion bonded thereto;

(c) producing a substantially flat uncoated working surface on only one end of the coated core by removing the coating therefrom; and (d) sintering the coated core having a substantially flat uncoated working surface to produce an integral monolithic body with an impervious coating layer, thereby forming a ceramic electrode having a substantially flat working surface and a non-working surface, said non-working surface having a coating of higher resistivity than said core and chemical diffusion bonded thereto, whereby substantially all of the current applied to said electrode is conducted into said electrolyte bath through said flat working surface.

6. A non-consumable electrode suitable for use as an anode in the electrolysis of molten salts, produced by the process of:

(a) forming a first conductive ceramic material to produce a core having a substantially flat working surface and a non-working surface;

(b) forming a physically adherent coating over said non-working surface of said core, on at least the portion thereof which is to be exposed to the electrolyte bath in the cell, said coating consisting of a second conductive ceramic material having, as compared to said first conductive ceramic material, (1) a coefficient of thermal expansion differing by no more than about 0.5%, (2) an essentially matched shrinkage during sintering, (3) a higher electrical resistivity, and capable of being chemical diffusion bonded thereto; and (c) sintering the coated core thus formed to produce a monolithic ceramic electrode having a substantially flat working surface and a non-working surface, said non-working surface having an impervious coating thereon, at least in the portion thereof exposed to the electrolyte bath, of higher resistivity than the core and chemical diffusion bonded thereto, whereby substantially all of the current applied to said electrode is conducted into the electrolyte bath through said flat working surface.

7. The electrode of claim 6 wherein the core consists of 98.0–98.5 wt. % $SnO_2$, 0.1–0.5 wt. % CuO and 1.0–1.5 wt. % $Sb_2O_3$.

8. The electrode of claim 7 wherein the core consists of 98.5 wt. % $SnO_2$, 0.5 wt. % CuO and 1.0 wt. % $Sb_2O_3$.

9. The electrode of claims 6, 7 or 8 wherein the coating consists of an $Fe_2O_3$-doped $SnO_2$ composition.

10. The electrode of claim 9 wherein the coating consists of 98.00–99.75 wt. % $SnO_2$ and 0.25–2.00 wt. % $Fe_2O_3$.

11. A non-consumable anode for a Hall-Heroult cell having a molten electrolyte bath at cell operating temperature produced by the process of:

(a) forming an elongated core having two ends from a first conductive ceramic material;

(b) forming a physically adherent coating over said core with a second conductive ceramic material having, as compared to said first conductive ceramic material, (1) a coefficient of thermal expansion differing by no more than about 0.5%, (2) an essentially matched shrinkage during sintering, (3) a higher electrical resistivity, and capable of being chemical diffusion bonded thereto;

(c) producing a substantially flat uncoated working surface on only one end of the coated core by removing the coating therefrom; and (d) sintering the coated core having a substantially flat uncoated working surface to produce an integral monolithic body with an impervious coating layer, thereby forming a ceramic anode having a substantially flat working surface and a non-working surface, said non-working surface having a coating of higher resistivity than said core and chemical diffusion bonded thereto, whereby substantially all of the current applied to said anode is conducted into said electrolyte bath through said flat working surface.

12. The anode of claim 11 wherein the core consists of 98.0–98.5 wt. % $SnO_2$, 0.1–0.5 wt. % CuO and 1.0–1.5 wt. % $Sb_2O_3$.

13. The anode of claim 12 wherein the core consists of 98.5 wt. % $SnO_2$, 0.5 wt. % CuO and 1.0 wt. % $Sb_2O_3$.

14. The anode of claims 11, 12 or 13 wherein the coating consists of an $Fe_2O_3$-doped $SnO_2$ composition.

15. The anode of claim 14 wherein the coating consists of 98.00–99.75 wt. % $SnO_2$ and 0.25–2.00 wt. % $Fe_2O_3$.

16. A non-consumable anode for a Hall-Heroult cell having a molten electrolyte bath at cell operating temperature produced by the process of:

(a) isostatically pressing a first conductive ceramic material to produce a core having a substantially flat working surface and a non-working surface;

(b) isostatically pressing a second conductive ceramic material having, as compared to said first conductive ceramic material, (1) a coefficient of thermal expansion differing by no more than about 0.5%, (2) an essentially matched shrinkage during sintering, (3) a higher electrical resistivity, and capable of being chemical diffusion bonded thereto to form a physically adherent coating over said non-working surface of said core, on at least the portion thereof which is to be exposed to the electrolyte bath in the cell; and (c) sintering the coated core thus formed to produce a monolithic ceramic anode having a substantially flat working surface and a non-working surface, said non-working surface having an impervious coating thereon, at least in the portion thereof exposed to the electrolyte bath, of higher resistivity than the core and chemical diffusion bonded thereto, whereby substantially all of the current applied to said anode is conducted into the electrolyte bath through said flat working surface.

17. The anode of claim 16 wherein the core consists of 98.0–98.5 wt. % $SnO_2$, 0.1–0.5 wt. % CuO and 1.0–1.5 wt. % $Sb_2O_3$.

18. The anode of claim 17 wherein the core consists of 98.5 wt. % $SnO_2$, 0.5 wt. % CuO and 1.0 wt. % $Sb_2O_3$.

19. The anode of claims 16, 17 or 18 wherein the coating consists of an $Fe_2O_3$-doped $SnO_2$ composition.

20. The anode of claim 19 wherein the coating consists of 98.00–99.75 wt. % $SnO_2$ and 0.25–2.00 wt. % $Fe_2O_3$.

21. A non-consumable anode for a Hall-Heroult cell having a molten electrolyte bath at cell operating temperature manufactured by the process of:

(a) producing an elongated core having two ends by isostatically pressing a first conductive ceramic material;

(b) forming a physically adherent coating over said core by isostatically pressing on the surface thereof a second conductive ceramic material having, as compared to said first conductive ceramic material, (1) a coefficient of thermal expansion differing by no more than about 0.5%, (2) an essentially matched shrinkage during sintering, (3) a higher electrical resistivity, and capable of being chemical diffusion bonded thereto;

(c) producing a substantially flat uncoated working surface on only one end of the coated core by removing the coating therefrom; and (d) sintering the coated core having a substantially flat uncoated working surface to produce an integral monolithic body with an impervious coating layer, thereby forming a ceramic anode having a substantially flat working surface and a non-working surface, said non-working surface having a coating of higher resistivity than said core and chemical diffusion bonded thereto, whereby substantially all of the current applied to said anode is conducted into said electrolyte bath through said flat working surface.

22. The anode of claim 21 wherein the core consists of 98.0–98.5 wt. % $SnO_2$, 0.1–0.5 wt. % CuO and 1.0–1.5 wt. % $Sb_2O_3$.

23. The anode of claim 22 wherein the core consists of 98.5 wt. % $SnO_2$, 0.5 wt. % CuO and 1.0 wt. % $Sb_2O_3$.

24. The anode of claims 21, 22 or 23 wherein the coating consists of an $Fe_2O_3$-doped $SnO_2$ composition.

25. The anode of claim 24 wherein the coating consists of 98.00–99.75 wt. % $SnO_2$ and 0.25–2.00 wt. % $Fe_2O_3$.

26. A non-consumable anode for a Hall-Heroult cell having a molten electrolyte bath at cell operating temperature produced by the process of:

(a) isostatically pressing a first conductive ceramic material consisting of a mixture of 98.5 wt. % $SnO_2$, 0.5 wt. % CuO and 1.0 wt. % $Sb_2O_3$ to produce a core having a substantially flat working surface and a non-working surface;

(b) isostatically pressing a second conductive ceramic material consisting of 98.0 wt. % $SnO_2$ and 2.0 wt. % $Fe_2O_3$ to form a physically adherent coating over said non-working surface of said core on at least the portion thereof which is to be exposed to the electrolyte bath in the cell; and (c) sintering the coated core thus formed to produce a monolithic ceramic anode having a substantially flat working surface and a non-working surface, said non-working surface having an impervious coating thereon, at least in the portion thereof exposed to the electrolyte bath, of higher resistivity than the core and chemical diffusion bonded thereto, whereby substantially all of the current applied to said anode is conducted into the electrolyte bath through said flat working surface.

27. A process for producing a non-consumable electrode suitable for use as an anode in the electrolysis of molten salts, which comprises:

(a) forming an elongated core having two ends from a first conductive ceramic material;

(b) forming a physically adherent coating over said core with a second conductive ceramic material having, as compared to said first conductive ceramic material, (1) a coefficient of thermal expansion differing by no more than about 0.5%, (2) an essentially matched shrinkage during sintering, (3) a higher electrical resistivity, and capable of being chemical diffusion bonded thereto;

(c) producing a sustantially flat uncoated working surface on only one end of the coated core by removing the coating therefrom; and (d) sintering the coated core having a substantially flat uncoated working surface to produce an integral monolithic body with an impervious coating layer, thereby forming a ceramic electrode having a substantially flat working surface and a non-working surface, said non-working surface having a coating of higher resistivity than said core and chemical diffusion bonded thereto, whereby substantially all of the current applied to said electrode is conducted into said electrolyte bath through said flat working surface.

28. The process of claim 27 wherein the electrode core consists of 98.0–98.5 wt. % $SnO_2$, 0.1–0.5 wt. % CuO and 1.0–1.5 wt. % $Sb_2O_3$.

29. The process of claim 28 wherein the electrode core consists of 98.5 wt. % $SnO_2$, 0.5 wt. % CuO and 1.0 wt. % $Sb_2O_3$.

30. The process of claims 27, 28 or 29 wherein the electrode coating consists of an $Fe_2O_3$-doped $SnO_2$ *composition.*

31. The process of claim 30 wherein the electrode coating consists of 98.00–99.75 wt. % $SnO_2$ and 0.25–2.00 wt. % $Fe_2O_3$.

* * * * *